US007886370B2

(12) United States Patent
Winningham

(10) Patent No.: US 7,886,370 B2
(45) Date of Patent: Feb. 15, 2011

(54) PROTECTIVE CHIN PAD ASSEMBLY FOR SPORTING HELMETS AND METHOD OF CONSTRUCTION THEREOF

(75) Inventor: Matthew M. Winningham, Royal Oak, MI (US)

(73) Assignee: Warrior Sports, Inc., Warren, MI (US)

( * ) Notice: Subject to any disclaimer, the term of this patent is extended or adjusted under 35 U.S.C. 154(b) by 274 days.

(21) Appl. No.: 12/121,021

(22) Filed: May 15, 2008

(65) Prior Publication Data

US 2009/0107514 A1 Apr. 30, 2009

Related U.S. Application Data

(60) Provisional application No. 61/001,199, filed on Oct. 31, 2007.

(51) Int. Cl.

| | |
|---|---|
| ***A42B 7/00*** | (2006.01) |
| ***A42B 1/06*** | (2006.01) |
| ***A42B 3/00*** | (2006.01) |
| ***A42B 1/24*** | (2006.01) |
| ***A42B 1/00*** | (2006.01) |
| ***A63B 71/10*** | (2006.01) |
| ***A41D 13/015*** | (2006.01) |

(52) U.S. Cl. ..... 2/421; 2/410; 2/411; 2/422; 2/425; 2/9; 2/455

(58) Field of Classification Search ..... 2/410, 2/6.1, 6.2, 6.6, 416, 417, 418, 419, 420, 421, 2/422, 424, 425, 455, 267, 268; 128/857
See application file for complete search history.

(56) References Cited

U.S. PATENT DOCUMENTS 2,867,811 A * 1/1959 Jones ..... 2/421
3,106,716 A * 10/1963 Beebe ..... 2/9
3,572,329 A * 3/1971 De Woskin ..... 606/204.15
3,619,813 A * 11/1971 Marchello ..... 2/421
3,682,164 A 8/1972 Miller
3,886,596 A 6/1975 Franklin et al.
4,028,743 A 6/1977 Christensen
5,027,479 A * 7/1991 Scheffczyk ..... 24/196
5,206,955 A 5/1993 Milligan (Continued)

FOREIGN PATENT DOCUMENTS

GB 1354719 A * 5/1974

*Primary Examiner*—Gary L Welch
*Assistant Examiner*—Jane S Yoon
(74) *Attorney, Agent, or Firm*—Warner Norcross & Judd LLP

(57) ABSTRACT

A chin pad assembly and method of construction thereof provides an outer shell of plastics material having straps attached thereto and an inner cushion member attached to the shell independently of the straps. The shell has an outer surface and an inner surface providing a pocket with a pair of openings formed in the shell between the outer and inner surfaces. The inner cushion member is received in the pocket of the shell and provides a pocket to receive a wearer's chin. An attachment mechanism has a pair of elongate members extending from an outer surface of the cushion member. Each of the elongate members is received through a separate one of the openings in the shell and coupled outwardly from the outer surface of the shell to releasably attach the cushion member to the shell independently of the straps.

20 Claims, 6 Drawing Sheets

U.S. PATENT DOCUMENTS 5,267,353 A 12/1993 Milligan
5,271,103 A 12/1993 Darnell
5,555,567 A 9/1996 Corpus
5,555,584 A * 9/1996 Moore et al. ..... 12/142 N
5,737,777 A * 4/1998 Hilleary ..... 2/421
5,794,274 A * 8/1998 Kraemer ..... 2/421
6,081,932 A * 7/2000 Kraemer ..... 2/421
6,298,483 B1 * 10/2001 Schiebl et al. ..... 2/9
6,324,701 B1 * 12/2001 Alexander ..... 2/421
6,381,760 B1 5/2002 Lampe et al.
6,453,476 B1 9/2002 Moore, III
6,481,024 B1 * 11/2002 Grant ..... 2/421
6,588,022 B1 7/2003 Anders et al.
6,772,447 B2 8/2004 Morrow et al.
6,865,752 B2 3/2005 Udelhofen et al.
6,883,183 B2 4/2005 Morrow et al.
7,036,151 B2 5/2006 Ide et al.
7,062,795 B2 6/2006 Skiba et al.
D526,449 S * 8/2006 Dawson et al. ..... D29/122
D526,746 S * 8/2006 Wong ..... D29/122
7,146,652 B2 12/2006 Ide et al.
7,152,253 B2 12/2006 Abelman et al.
7,240,376 B2 7/2007 Ide et al.
D606,707 S * 12/2009 Schiebl ..... D29/122
2004/0003452 A1 * 1/2004 Schiebl ..... 2/421
2005/0102737 A1 * 5/2005 Worthing ..... 2/421
2007/0124842 A1 * 6/2007 Nascimento et al. ..... 2/9

* cited by examiner

PROTECTIVE CHIN PAD ASSEMBLY FOR SPORTING HELMETS AND METHOD OF CONSTRUCTION THEREOF

CROSS-REFERENCE TO RELATED APPLICATION

This application claims the benefit of U.S. Provisional Application Ser. No. 61/001,199, filed Oct. 31, 2007, which is incorporated herein by reference in its entirety.

BACKGROUND OF THE INVENTION

1. Technical Field

This invention relates generally to protective sporting equipment, and more particularly to chin pad assemblies for helmets and their method of construction.

2. Related Art

In contact or otherwise aggressive, high impact sports, such as lacrosse, hockey, or football, for example, where sticks and hard hitting and high impact forces are essential elements of the sport, a participant's head is especially vulnerable to injury when being checked or otherwise impacted by another participant's stick or helmet, or experiencing relatively high impact forces, such as from hitting the ground. For this reason, participants typically utilize helmets to protect their heads.

To facilitate maintaining the helmet on the wearer's head, a strap is commonly used. The straps are typically attached at free ends to the helmet, such as via snaps, and loop beneath the wearer's chin. The straps commonly have a chin pad formed thereon or attached thereto to provide further protection to the wearer's chin. Chin pad assemblies are known to include a hard outer shell and a softer inner pad material. The hard outer shell helps reduce abrasion and impact forces, while the soft inner shell helps to provide comfort and cushions the impact forces to the user's chin. The inner pad material is commonly secured to the outer shell via a stitching or an adhesive. It is also known to secure the shell and inner pad in attached relation to one another by looping the straps through aligned openings adjacent opposite ends of the shell and the inner pad. It has also been suggested that Velcro® be applied to the surfaces of both the outer shell and the inner pad to provide their attachment to one another.

Due to the nature of the sports requiring head and chin protection, the protective gear, including the chin pad assemblies, become worn and dirty. This results generally from the hard hitting nature of the sports and the dirt and perspiration encountered during play. As such, it becomes desirable to replace the old gear, including the chin straps with chin pad assemblies, for new gear. Unfortunately, replacing a helmet and/or chin straps and chin pad assemblies can be costly. Even where a chin pad assembly has a chin pad attached to an outer shell via application of Velcro® applied to the confronting surfaces of both the outer shell and inner pad, the Velcro® can become worn due to shear force generated across the hooks and loops, thereby requiring the entire chin strap and chin pad assembly to be replaced. Accordingly, although the chin straps or hard outer shell may otherwise be useful, it may become necessary to replace them along with the chin pads.

SUMMARY OF THE INVENTION

A chin pad assembly has an outer shell of plastics material with straps attached thereto and an inner cushion member attached to the outer shell independently of the straps. The outer shell has a convex outer surface and a concave inner surface providing a pocket for receipt of the inner cushion member. The outer shell further has a pair of openings to facilitate attachment of the inner cushion member thereto. The inner cushion member has a convex outer surface received in the pocket of the outer shell and a concave inner surface providing a pocket to receive a wearer's chin. An attachment mechanism provides a pair of elongate members extending from the outer surface of the cushion member. Each of the elongate members is received through a separate one of the openings in the outer shell and coupled outwardly from the convex outer surface of the outer shell to releasably attach the inner cushion member to the outer shell independently of the straps.

Another aspect of the invention provides a method of constructing a chin pad assembly. The method includes providing a rigid outer shell of plastics material having a convex outer surface and a concave inner surface, providing a pocket and attaching a pair of straps configured for attachment to a helmet to opposite ends of the outer shell. Further, the method includes providing an inner cushion member having a convex outer surface and a concave inner surface, providing a pocket for a wearer's chin and extending a pair of elongate members from the outer surface of the cushion member. Then, the method includes disposing the outer convex surface of the inner cushion member in the pocket of the outer shell and coupling the elongate members outwardly from the convex outer surface of the outer shell to releasably attach the inner cushion member to the outer shell independently of the straps.

BRIEF DESCRIPTION OF THE DRAWINGS

These and other aspects, features and advantages of flexible shielding for protective sporting equipment and protective sporting equipment therewith will become more readily appreciated by one of ordinary skill in the art when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
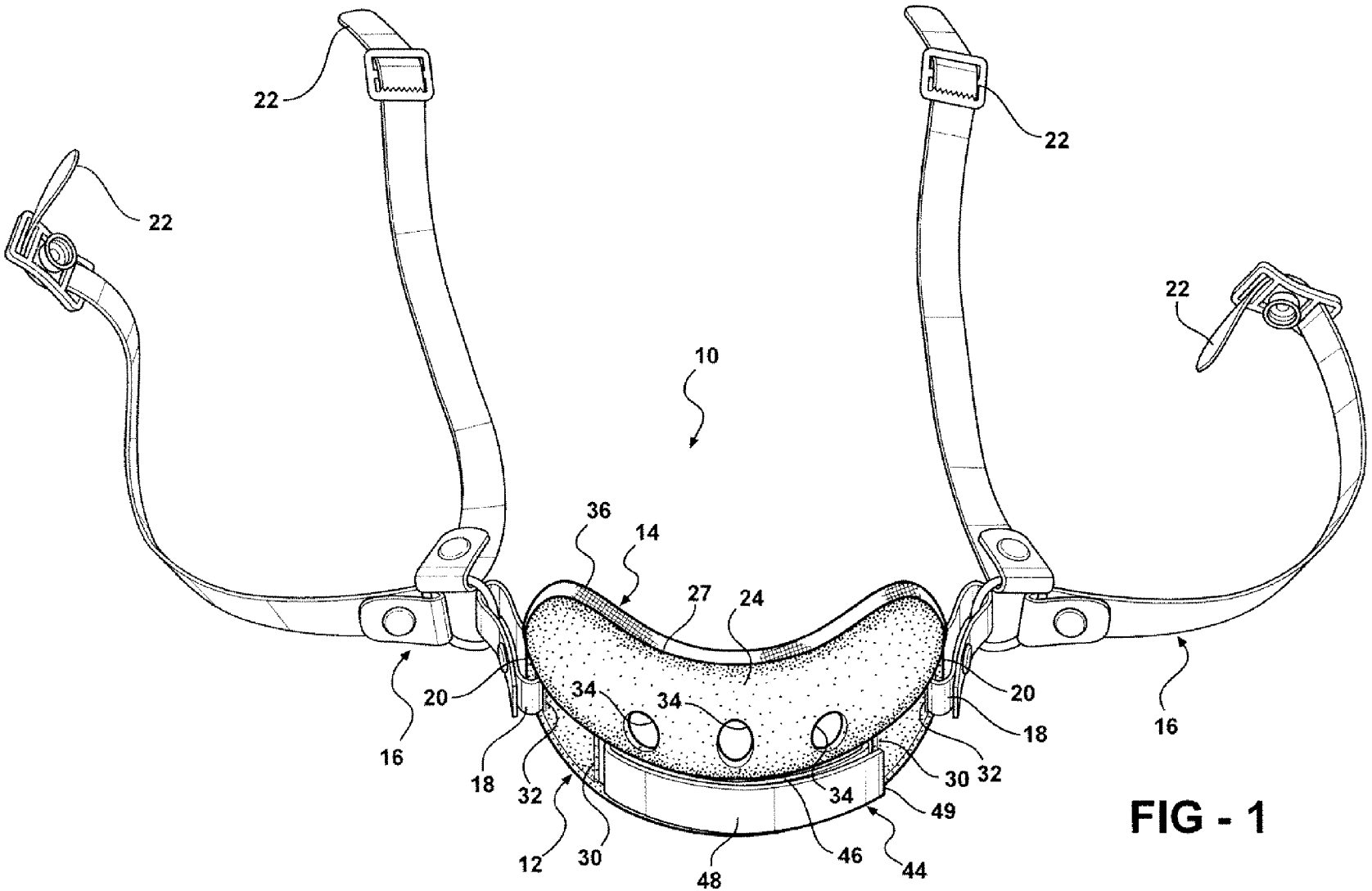
FIG. 1 is a perspective view of a protective chin pad assembly according to one aspect of the invention.
Figure 2:
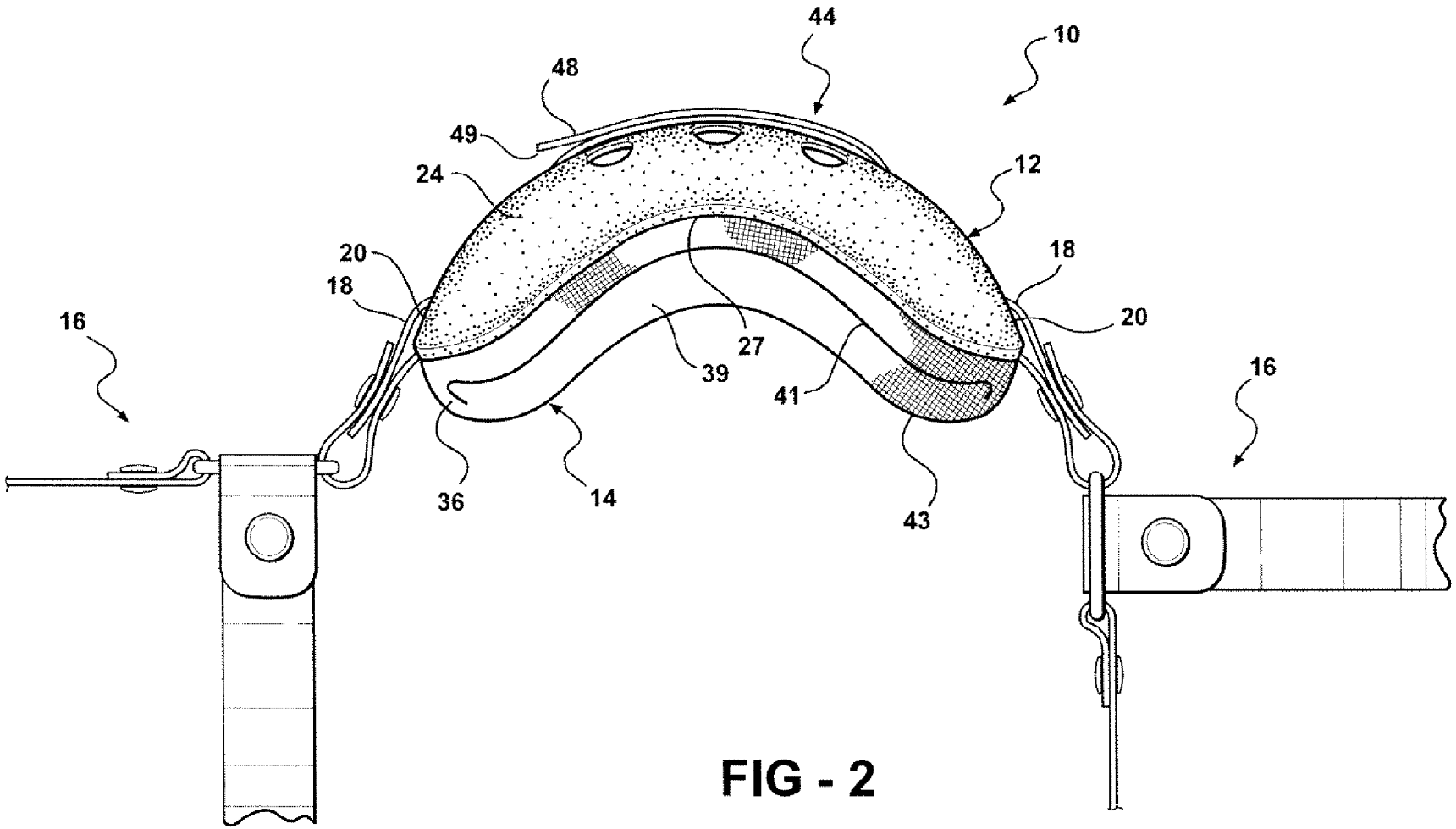
FIG. 2 is another perspective view of the assembly of FIG. 1.

Referring in more detail to the drawings, FIGS. 1 and 2 illustrate a protective chin pad assembly 10 constructed in accordance with one presently preferred embodiment of the invention. The chin pad assembly 10 has a generally rigid, hard outer shell 12 to deflect objects or things impacting the assembly 10 and a relatively soft inner cushion member, referred to hereafter as a chin pad 14, to provide comfort against a wearer's chin and to reduce the impact forces transferred to the wearer's chin. The assembly 10 has at least a pair of straps or strap assemblies 16 with ends 18 configured for attachment to opposite ends 20 of the outer shell 12 and ends 22 configured for attachment to a protective helmet (not shown), such as those used in lacrosse, hockey, football, or other sporting events requiring protective helmets. It will be understood that the assembly 10 can be utilized in connection with a variety of different helmets for different purposes.

The chin pad 14 is attached to the outer shell 12 separately from the chin straps 16 in a manner that allows the chin pad 14 to be readily removed from the outer shell 12, while being assured of the outer shell 12 remaining secured to a helmet for use. Accordingly, the chin pad 14 can be readily removed, when desired, from the outer shell 12 to enable replacement of the chin pad 14 without having to replace other components of the assembly 10, such as may be desired if the chin pad 14 becomes worn or dirty, such as from perspiration. Otherwise, the chin pad 14 remains reliably attached to the outer shell 12 in use without concern of its becoming inadvertently detached from the outer shell 12.

Figure 3:
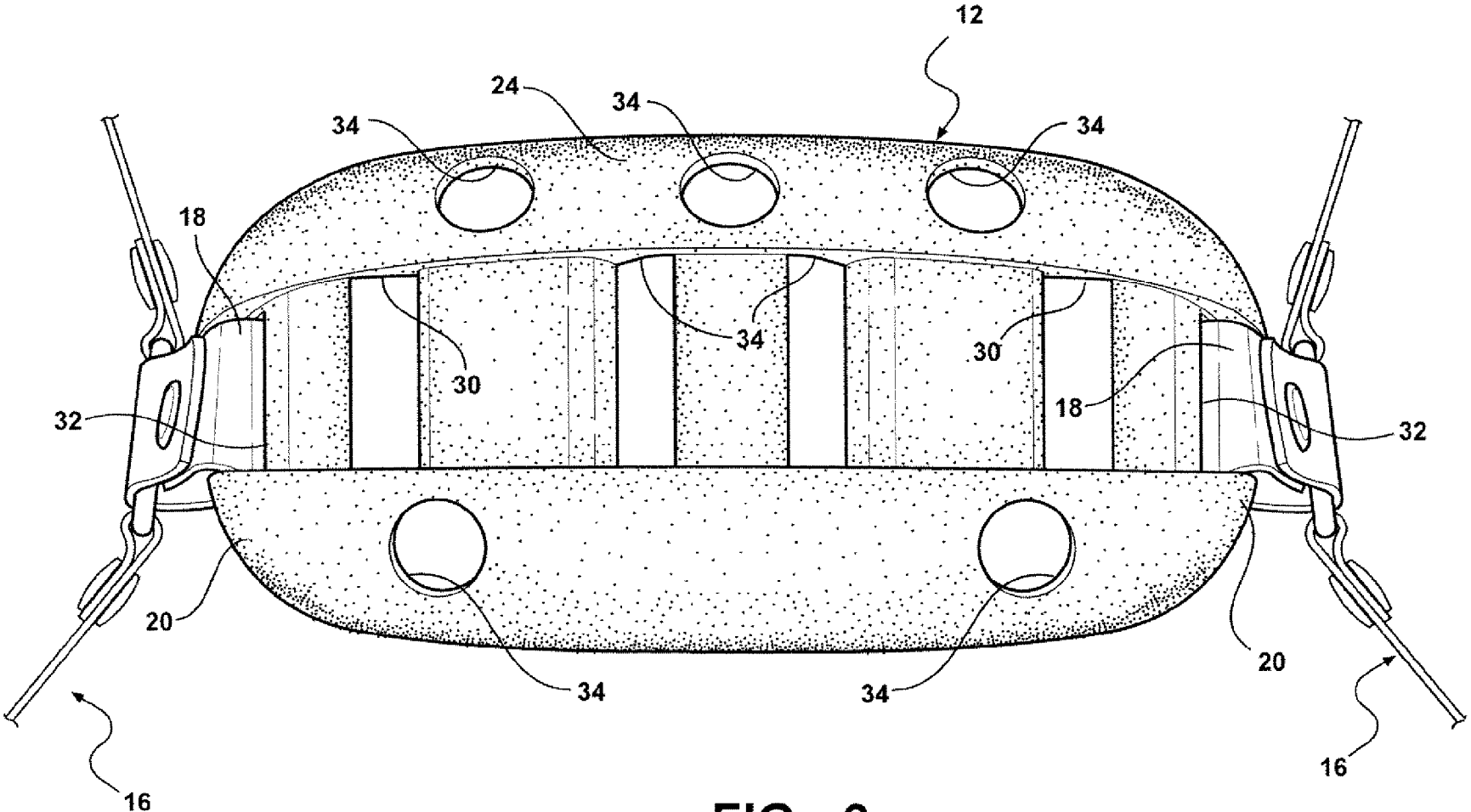
FIG. 3 is a front view of an outer shell of the assembly of FIG. 1.
Figure 4:
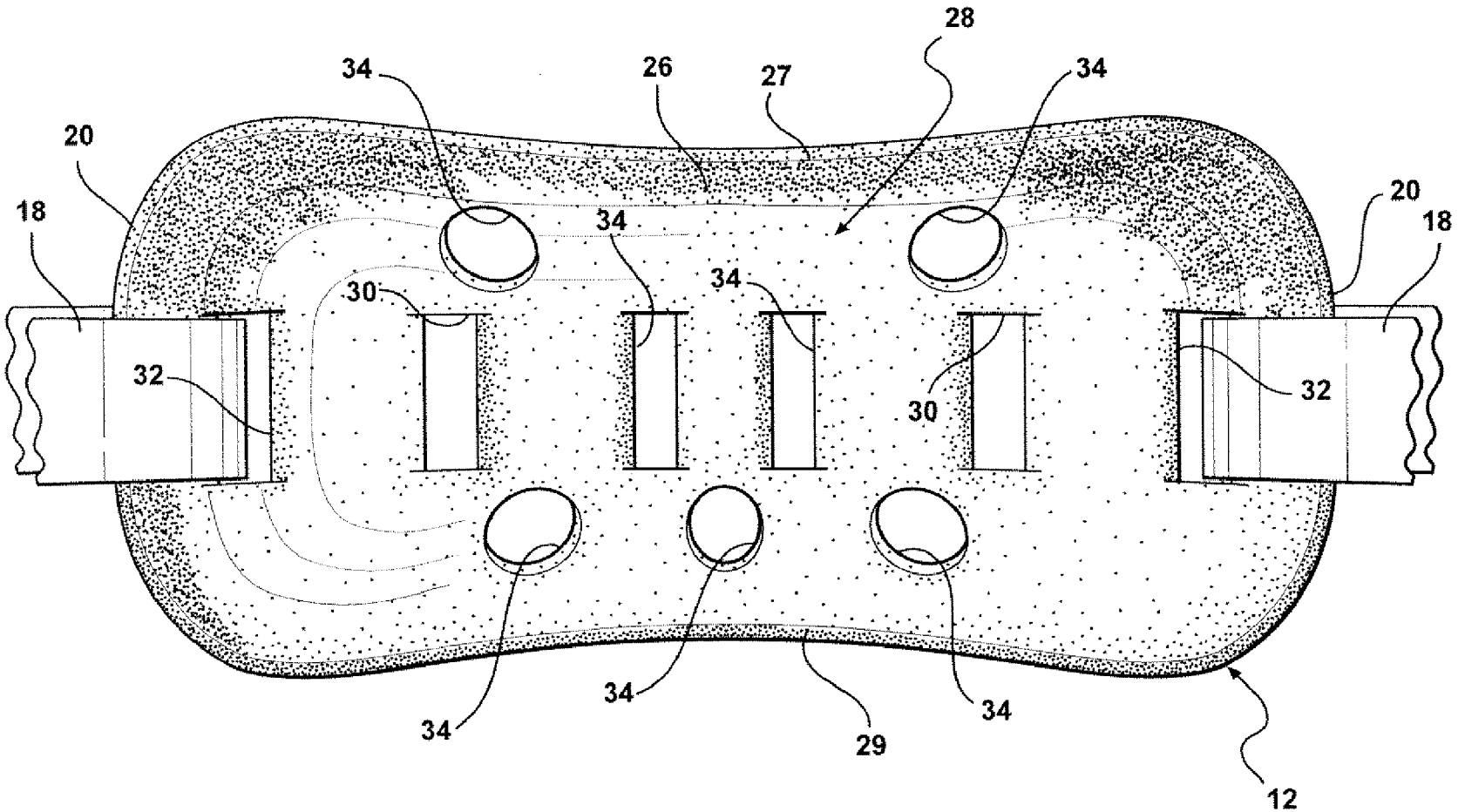
FIG. 4 is a rear view of the outer shell of the protective chin pad assembly of FIG. 1.
Figure 5:
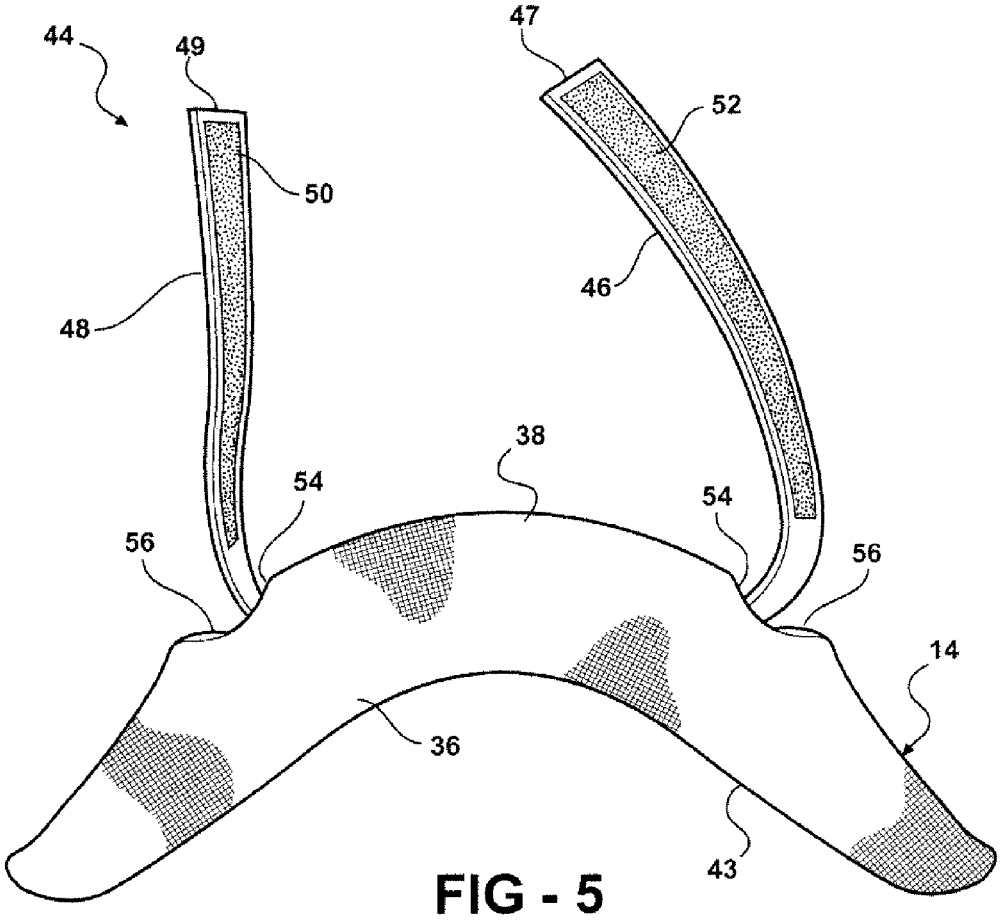
FIG. 5 is a top view of an inner cushion member of the protective chin pad assembly of FIG. 1.
Figure 6:
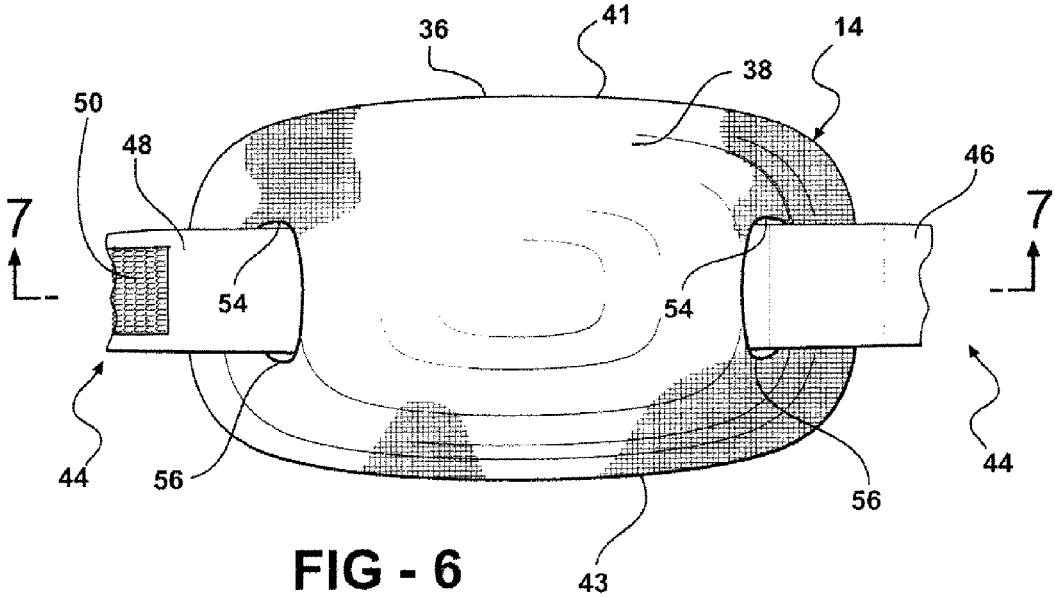
FIG. 6 is a front view of the inner cushion member of the protective chin pad assembly of FIG. 1.
Figure 7:
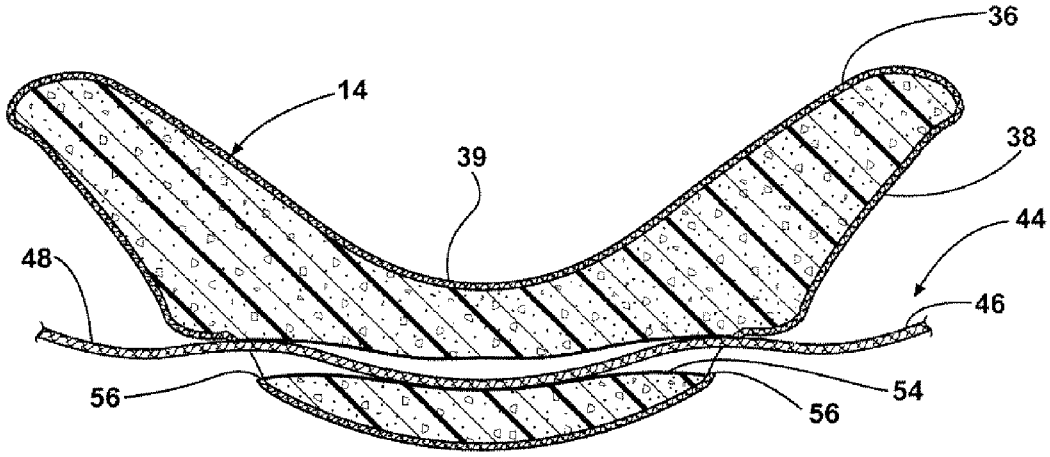
FIG. 7 is a cross-sectional view taken generally along line 7-7 of FIG. 6.
Figure 8:
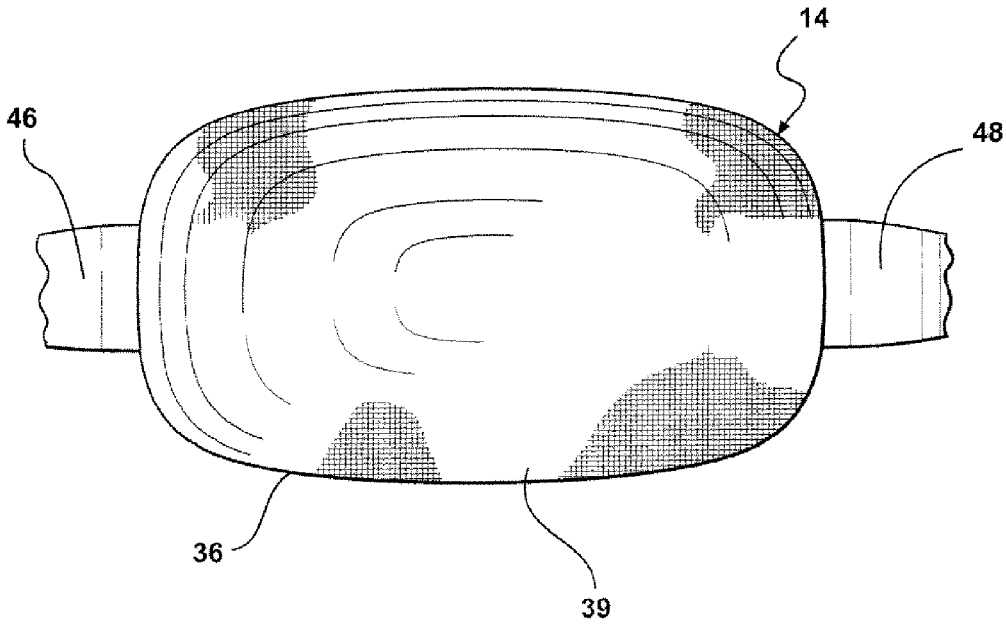
FIG. 8 is a rear view of the inner cushion member of the protective chin pad assembly of FIG. 1.

The outer shell 12 is constructed from a relatively high strength, hard material, such as polypropylene (PP), polycarbonate (PC), acrylonitrile butadiene styrene (ABS), PC/ABS compounds, styrene and/or high impact styrene (HIPS), nylon 6 and/or 6,6 (PA6, PA66), polyethylene (PE), copolyester, propionate, and acetal (POM), for example. The outer shell 12 has a substantially convex outer surface 24 (FIG. 3) and a substantially concave inner surface 26 (FIG. 4) extending along upper and lower edges 27, 29 between the opposite ends 20. The upper and lower edges 27, 29 are arcuate and have a substantially uniform radius of curvature configured to follow the general shape of the wearer's chin. The convex shape of the outer surface 24 facilitates deflecting objects away from the wearer's chin upon impact, and thus, reduces the impact force transferred to the wearer. The concave inner surface 26 is generally shaped to provide a cup-shaped pocket 28 configured to receive the chin pad 14 at least partially therein.

The outer shell 12 has a pair of through openings, represented here, by way of example, as slots 30 spaced laterally from one another and equidistantly from the opposite ends 20 of the shell 12. In addition, the outer shell 12 has a pair of through openings 32 located between the respective slots 30 and opposite ends 20. The openings 32 are sized to receive the ends 18 of the straps 16 to facilitate attachment of the straps 16 to the outer shell 12. Further, the outer shell 12 can have a plurality of through openings or vents 34. The vents 34 are represented here, by way of example and without limitation, as including three vents adjacent the upper edge 27 and a pair of vents 34 adjacent the lower edge 29, with two additional vents 34 located between the slots 30. It should be recognized that the size, shape, location and number of the vents 34 can be varied, as desired.

The chin pad 14 is constructed of a generally rigid and resilient material, or combination of materials, such as a foam material, rubber material, or combination thereof, and can have an outer layer of textile material or combination of materials thereover, such as a woven cloth material, e.g., Lycra and/or Vaportek, for example, as desired. The material(s) used can be laminated as desired to provide a desired finish thickness. The lamination can be performed by using a suitable adhesive between the layers, particularly about an outer periphery 36 of the chin pad 14. Of course, the layers could be stitched about the outer periphery 36, or otherwise attached to one another, as desired.

The chin pad 14 has a substantially convex outer surface 38 and a substantially concave inner surface 39 extending along upper and lower edges 41, 43 between the opposite ends 40. The upper and lower edges 41, 43 are generally shaped similar to the upper and lower edges 27, 29 of the outer shell 12, and thus, are arcuate and have a substantially uniform radius of curvature configured to follow the general shape of the wearer's chin. The convex shape of the outer surface 38 is shaped generally the same as the inner surface 26 of the outer shell 12. As such, the outer surface 38 of the chin pad 14 generally abuts the inner surface of the outer shell 12 upon assembly. To facilitate conforming of the outer surface 38 with the inner surface 26, the outer surface can be fabricated at least in part from Lycra, as noted above. The concave inner surface 39 is generally shaped to provide a cup-shaped pocket configured to receive the wearer's chin therein. The inner surface 39 can be fabricated using Vaportek, as noted above, to facilitate absorption of perspiration, although others suitable materials could be used.

The chin pad 14 has an attachment mechanism 44 for securing the chin pad 14 to the outer shell 12 independently from the straps 16. The attachment mechanism 44 includes elongate members, also referred to as straps 46, 48, extending outwardly from the convex outer surface 38 to free ends 47, 49. The straps 46, 48 are sized for receipt through the openings or slots 30 in the outer shell 12 upon disposing the chin pad 14 within the pocket 28 of the outer shell 12. Upon disposing the chin pad 14 in the pocket 28 and the straps 46, 48 through the slots 30, the free ends 47, 49 can be secured or coupled to one another externally or outwardly from the outer surface 24 of the outer shell 12 to prevent inadvertent removal of the chin pad 14 from the outer shell 12.

To facilitate securing or coupling the free ends 47, 49 of the straps 46, 48 to one another, a fastener can be attached to the straps 46, 48, wherein the fastener is shown here, by way of example and without limitation, as a hook and loop fastener, with hooks 50 being attached to one strap 48 and loops 52 being attached to the other strap 46 adjacent their respective ends 47, 49. As such, upon feeding the straps through the openings 32, the regions of the straps 46, 48 adjacent the free ends 47, 49 can be pressed together in overlapping relation to one another to bring the hooks 50 and loops 52 into fastening engagement with one another. Of course, it should be recognized that other fastening mechanisms could be attached adjacent the free ends 47, 49, such as snaps, for example. Otherwise, the free ends 47, 49 could be provided with strings that could be tied to one another. Regardless of the attachment mechanism selected, the chin pad 14 is reliably secured to the outer shell 12 without directly adhering the chin pad 14 to the outer shell 12. As such, there are no substantial shear forces exerted across the attachment mechanism 44, as with other known mechanisms which use fasteners attached to both the chin pad and outer shell.

The straps 46, 48 of the attachment mechanism 44 can be provided as separate pieces of material attached individually to the chin pad 14, or as a single piece of material. If provided as a single piece of material, a passage or pocket 54 can be formed through the chin pad 14 such that the pocket 54 extends between the outer and inner surfaces 38, 39 to opposite openings 56 exiting the outer surface 38. The single strap member can then be fed through the pocket 54, or it could be introduced within the pocket 54 during a lamination process used to construct the chin pad 14. With the straps 46, 48 being provided as a single piece member, and being attached or coupled to the chin pad 14 without the assistance of secondary fastening mechanisms, the manufacturing process is simplified and made economical. Further, with the straps 46, 48 being constructed as a single piece of material slideably received in the pocket 54, it is possible to replace the single piece straps 46, 48 should they become worn. This is facilitated by the ability to slide the old strap out of the pocket 54 and reintroducing a new strap through the pocket 54. It should be recognized that a strap of a single piece of material could otherwise be attached to the chin pad 14, such as by being adhered or stitched to the outer surface 38, if desired.

In accordance with another aspect of the invention, a method of constructing the chin pad assembly 10 is provided. The method includes providing a rigid outer shell 12 of plastics material having a convex outer surface 24 and a concave inner surface 26 providing a pocket 28 and attaching a pair of straps 16 configured for attachment to a helmet to opposite ends 20 of the outer shell. Further, providing an inner cushion member or pad 14 having a convex outer surface 38 and a concave inner surface 39 providing a pocket for a wearer's chin and extending a pair of elongate members 46, 48 from the outer surface 38 of the cushion member 14. Then, disposing the outer convex surface 38 of the inner cushion member 14 in the pocket 28 of the outer shell 12 and coupling the elongate members 46, 48 outwardly from the convex outer surface 24 of the outer shell 12 to releasably attach the inner cushion member 14 to the outer shell 12 independently of the straps 16.

The method can further include forming a pair of openings 30 through the outer and inner surfaces 24, 26 of the outer shell 12 and extending the elongate members 46, 48 through the openings 30 while disposing the inner cushion member 14 in the pocket 28. Further yet, the method can include forming the elongate members 46, 48 as a single piece attachment mechanism or member 44. In addition, the method can include forming a passage 54 extending between the outer and inner surfaces 38, 39 of the cushion member 14 with the passage 54 exiting the outer surface 38 of the cushion member 14 and disposing the single piece member 44 through the passage 54. Accordingly, if under any circumstances the attachment mechanism 44 becomes damaged or simply worn, it can be readily removed from the cushion member 14 by sliding it out of the passage 54 and replaced with a new attachment mechanism 44.

Obviously, many modifications and variations of the present invention are possible in light of the above teachings. For example, the method of construction can include additional steps in accordance with attaining the various aspects of the chin strap assembly structure discussed above. It is, therefore, to be understood that within the scope of the appended claims, the invention may be practiced otherwise than as specifically described.

What is claimed is:

1. A chin pad assembly, comprising:

an outer shell extending between opposite ends and having an outer surface and an inner surface providing a pocket with at least one opening extending through said inner and outer surfaces;

at least two first straps operably attached to said opposite ends of said outer shell, said at least two first straps adapted to attach to a helmet;

an inner cushion member having an outer surface received in said pocket and a concave inner surface providing a pocket for a wearer's chin; and an attachment mechanism providing at least two flexible elongate members separate from said at least two first straps extending from said outer surface of said cushion member, said at least two elongate members being received through said at least one opening in said outer shell and coupled outwardly from said outer surface of said outer shell wherein said at least two flexible elongate members releasably attach said inner cushion member to said outer shell independently of said at least two first straps so that said inner cushion is manually removable from said outer shell without detaching the at least two first straps from said opposite ends of said outer shell.

2. The chin pad assembly of claim 1 wherein said cushion member has a passage located between said outer and inner surfaces of said cushion member, said passage entering and exiting said outer surface of said cushion member through a pair of laterally spaced openings in said outer surface of said cushion member and receiving said attachment mechanism at least partially therethrough.

3. The chin pad assembly of claim 2 wherein said at least two elongate flexible members are connected to form a single piece of material slideably received through said passage, said at least two elongate flexible members extending outwardly from said outer surface of said cushion through each of said laterally spaced openings, said at least two elongate flexible members including opposite free ends.

4. The chin pad assembly of claim 3 wherein said free ends are configured to overlay one another.

5. The chin pad assembly of claim 4 wherein said attachment mechanism has hooks adjacent one of said free ends and loops adjacent the other of said free ends, said hooks and loops being configured for releasable attachment to one another.

6. The chin pad assembly of claim 1 wherein said attachment mechanism is a single piece of material.

7. The chin pad assembly of claim 6 wherein said cushion member has a pair of laterally spaced openings receiving said attachment mechanism therethrough.

8. The chin pad assembly of claim 1 wherein said elongate members are configured for attachment to one another outwardly from said outer surface of said outer shell.

9. The chin pad assembly of claim 8 wherein one of said at least two elongate members has hooks and the other of said elongate members has loops, said hooks and loops being configured for releasable attachment to one another outwardly from said outer surface of said outer shell.

10. A chin pad assembly for attachment to a protective helmet, comprising:

a hard outer shell extending between opposite ends and having an outer surface and a concave inner surface providing a pocket;

a pair of first straps operably attached to said opposite ends of said outer shell;

an inner cushion member having an outer surface received in said pocket and a concave inner surface providing a pocket for a wearer's chin; and at least two flexible elongate members extending from said cushion member, at least a portion of one of said at least two flexible elongate members overlaying at least a portion of another one of said at least two flexible elongate members, the flexible elongate members coupled to one another forwardly of said outer surface of said outer shell, said at least two flexible elongate members releasably attaching said inner cushion member to said outer shell independently of said first straps;

wherein said at least two flexible elongate members releasably attach said inner cushion member to said outer shell independently of said pair of first straps so that said inner cushion is manually removable from said outer shell without detaching the pair of first straps from said opposite ends of said outer shell;

wherein the outer shell defines an opening through which at least one of the elongate members is positioned.

11. The chin pad assembly of claim 10 further including at least two openings extending through said inner and outer surfaces of said outer shell, said at least two elongate members extending through respective ones of said openings.

12. The chin pad assembly of claim 11 wherein said cushion member has a passage located between said outer and inner surfaces of said cushion member, said passage entering and exiting said outer surface of said cushion member through a pair of laterally spaced openings in said outer surface and respectively receiving said at least two flexible elongate members at least partially therethrough.

13. The chin pad assembly of claim 12 wherein said at least two flexible elongate members are joined and form a single piece of material.

14. The chin pad assembly of claim 11 wherein said at least two flexible elongate members include a pair of free ends configured for attachment to one another.

15. The chin pad assembly of claim 14 wherein said at least two flexible elongate members have hooks adjacent one of said free ends and loops adjacent the other of said free ends, said hooks and loops being configured for releasable attachment to one another.

16. A method of modifying a chin pad assembly, comprising:

providing a rigid outer shell having an outer surface and an inner surface providing a pocket;

attaching a pair of first straps, configured for attachment to a helmet, to said outer shell;

providing an inner cushion member having an outer surface and a concave inner surface providing a pocket for a wearer's chin;

extending at least two second straps that are flexible from said outer surface of said cushion member, the second flexible straps being separate and independent from said pair of first straps;

disposing said outer surface of said inner cushion member in said pocket of said outer shell; and coupling said at least two second flexible straps so that at least one strap from the second flexible straps overlaps at least one of the other straps from the second flexible straps outwardly of the outer surface of the outer shell, said second flexible straps releasably attaching said inner cushion member to said outer shell independently of said first pair of straps;

wherein the outer shell defines an opening through which at least one strap from the second flexible straps is positioned.

17. The method of claim 16 further including forming a pair of openings through said inner and outer surfaces of said outer shell and extending said second flexible straps through said openings and disposing said inner cushion member in said pocket.

18. The method of claim 17 further including forming said pair of second flexible straps as a single piece member.

19. The method of claim 16 comprising:

attaching the pair of first straps to a helmet;

removing the inner cushion from the rigid outer shell by removing the second flexible straps from the rigid outer shell, while leaving the pair of first straps attached to the helmet.

20. A method of modifying a chin pad assembly, comprising:

providing a rigid outer shell having an outer surface and an inner surface providing a pocket;

attaching at least two primary straps to the rigid outer shell;

providing an inner cushion member having an outer surface and an inner surface providing a pocket for a wearer's chin;

extending at least two flexible secondary straps from the outer surface of the inner cushion member, the at least two flexible secondary straps being separate and independent from the at least two primary straps;

positioning the inner cushion member adjacent the pocket of the rigid outer shell;

positioning the at least two secondary straps outwardly from said rigid outer shell and adjacent the rigid outer shell so as to releasably attach the inner cushion member to the rigid outer shell independently of the at least two primary straps; and removing the inner cushion from the rigid outer shell by removing the at least two secondary flexible straps from the rigid outer shell, while leaving all of the at least two primary straps attached to the helmet and attached to the rigid outer shell;

wherein at least one of the flexible secondary straps is positioned through an opening defined by the outer shell.

* * * * *